US005326041A

United States Patent [19]

Alexander, III et al.

[11] Patent Number: 5,326,041

[45] Date of Patent: Jul. 5, 1994

[54] WEB ROLL CONTROL AND METHOD

[75] Inventors: William J. Alexander, III, Mauldin; Shala W. Summey, III, Greenville, both of S.C.

[73] Assignee: Alexander Machinery, Inc., Mauldin, S.C.

[21] Appl. No.: 969,991

[22] Filed: Nov. 2, 1992

[51] Int. Cl.[5] ..... B65H 16/00

[52] U.S. Cl. ..... 242/563; 242/595.1

[58] Field of Search ..... 242/57, 65, 66, 75.1, 242/78.7, 78.8, 68.7, 75.51, 75.52

[56] References Cited

U.S. PATENT DOCUMENTS

| | | | |
|---|---|---|---|
| 2,984,429 | 5/1961 | Huck | 242/75.1 |
| 3,202,376 | 8/1965 | Dutro et al. | 242/75.1 |
| 3,391,877 | 7/1968 | Angell et al. | 242/57 |
| 3,737,115 | 6/1973 | Baker | 242/75.1 |
| 3,818,809 | 6/1974 | Sylvester | 242/75.1 X |
| 3,974,490 | 8/1976 | Mori | 242/57 X |
| 4,278,213 | 7/1981 | Rubruck | 242/75.1 |
| 4,543,152 | 9/1985 | Nozaka | 242/57 X |
| 4,729,519 | 3/1988 | Tafel et al. | 242/75.51 X |
| 4,858,843 | 8/1989 | Gierse et al. | 242/66 X |
| 5,150,850 | 9/1992 | Adams | 242/66 |
| 5,160,098 | 11/1992 | Durkos | 242/75.51 |
| 5,172,871 | 12/1992 | Schütt et al. | 242/68.7 X |
| 5,195,690 | 3/1993 | Cross et al. | 242/75.51 X |
| 5,209,418 | 5/1993 | Alexander, III | 242/58.6 |

FOREIGN PATENT DOCUMENTS

| | | | |
|---|---|---|---|
| 2-175550 | 7/1990 | Japan | 242/57 |

*Primary Examiner*—Daniel P. Stodola
*Assistant Examiner*—John P. Darling
*Attorney, Agent, or Firm*—Ralph Bailey

[57] ABSTRACT

A web roll (A) is positioned on a winding apparatus which includes a belt (B). An electric drive motor (C) drives the belt (B) roll (A) during winding and unwinding of the web. An ultrasonic signaling device (D) directs a signal downwardly towards the web roll and receives a return signal indicative of the size of the web roll for controlling the operation of the electric drive motor which rotates the web roll in a clockwise or counterclockwise direction.

3 Claims, 2 Drawing Sheets

WEB ROLL CONTROL AND METHOD

BACKGROUND OF THE INVENTION

This invention relates to an improvement in web roll control mechanisms such as apparatus for unwinding a web such as disclosed in U.S. patent application Ser. No. 07/816,173, entitled WEB UNWINDING APPARATUS AND METHOD, filed Jan. 2, 1992, and now U.S. Pat. No. 5,209,418.

When unwinding a web from a web roll wound upon a core roll it is desirable to control the winding apparatus so as to slow down the unwinding operation especially when the web is about to run out and the web roll is therefor relatively small. At that juncture, due to the action of the looped belt moving in one direction, the web roll has a tendency to rock back and forth in such a way as to limit the usefulness of detectors utilizing horizontally disposed light beams and the like for controlling the speed of the unwinding. It is also possible that at some point, determined by web roll size, it may become desirable to reverse the belt let off and to wind a certain amount of the web so that accurately determining roll size becomes important.

While the web roll control and method hereof is described in connection with a belt let off of the type illustrated in U.S. patent application, Ser. No. 07/816,173, it may be desirable to utilize such in connection with determining the size of web rolls and the like in other configurations.

SUMMARY OF THE INVENTION

Accordingly, it is an important object of the invention to provide an improved web control apparatus and method which is especially useful in connection with unwinding a web roll upon a belt let off.

Another important object of the invention is the providing of an accurate sensing means for determining the size of a web roll during a winding or unwinding operation for generating a signal for controlling a drive mechanism for the web roll so as to automatically control speed of winding or unwinding responsive to web roll size.

Still another object of the invention is to provide a control apparatus for winding and unwinding a web roll utilizing an ultrasonic transducer positioned above the web for sending and receiving signals indicative of the web roll size for controlling the drive mechanism therefor.

The method contemplates utilizing an ultrasonic detecting mechanism or transducer sending and receiving a signal indicative of the web roll size which is especially useful in connection with a belt let off.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
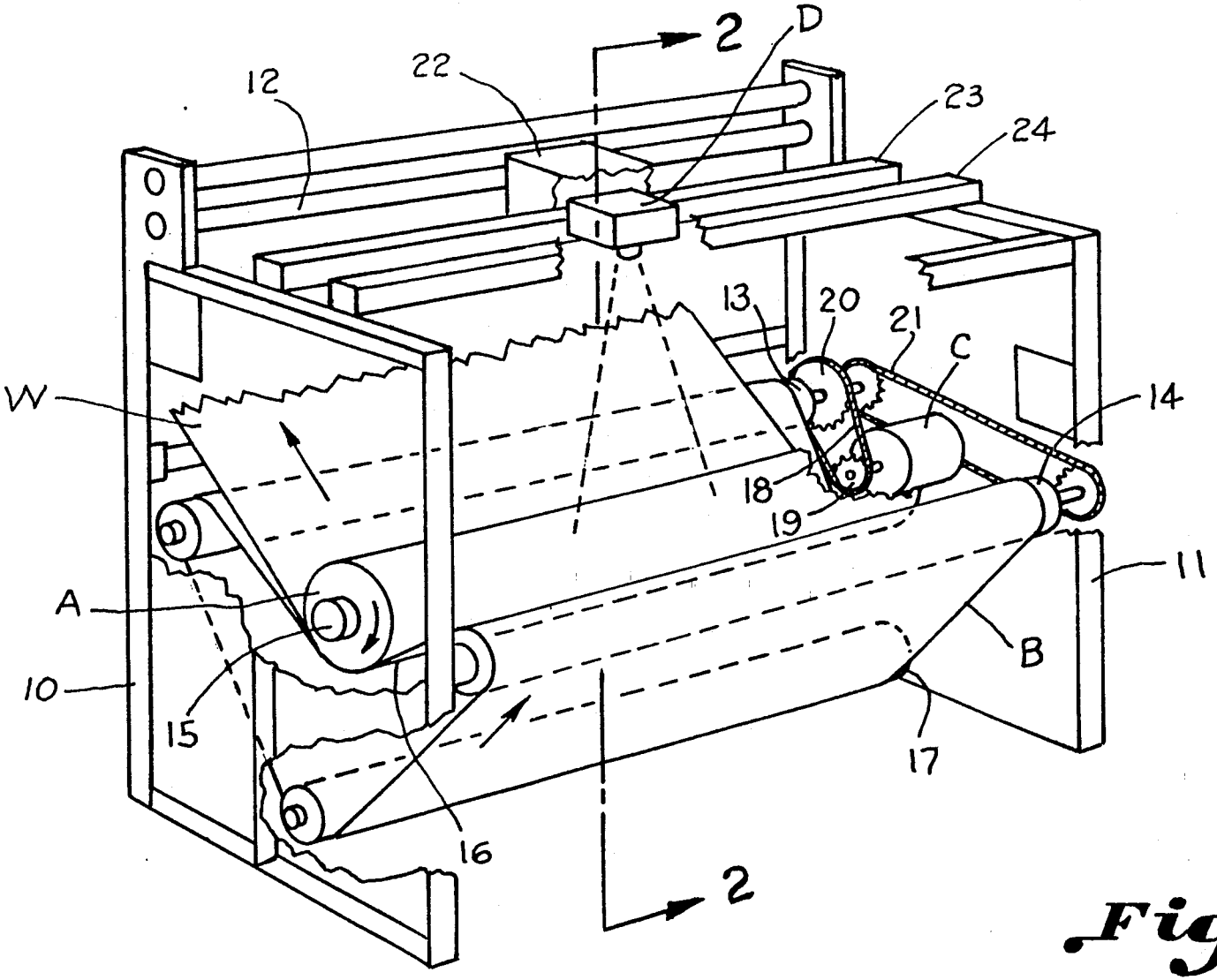
FIG. 1 is a perspective view illustrating a web roll control apparatus and method in accordance with the invention on a belt let off.

The drawings illustrate apparatus for unwinding a web roll. A control device for positioning a web roll A for winding and unwinding a web from the roll thereby varying the size of the web roll is illustrated as including a driven belt supporting the web roll between spaced support rolls. An electric motor C drives the web roll through the belt B during winding and unwinding. An ultrasonic transducer D is carried above and directed downwardly toward the web roll to send a signal and receive a return signal indicative of the size of the web roll. Signalling means E are actuated by the ultrasonic transducer when the web roll reaches a predetermined size producing a change of operation in the electric motor. The control device includes alternate web delivery means, and control means therefor selected responsive to the web delivery means being utilized.

The description hereof is in the context of a belt let off which is illustrated as including a pair of end frame members 10 and 11 which are bridged by suitable horizontal frame members 12. The frame members support a pair of spaced aligned substantially horizontal rolls 13 and 14 for carrying a looped belt B thereabout which supports a cloth roll A upon a roll core 15. The cloth roll is carried in a trough 16 formed in the substantially horizontally run of the belt B which extends between the rolls 13 and 14. A third roll 17 is carried within the loop formed by the belt B at a lower portion thereof.

Figure 3:
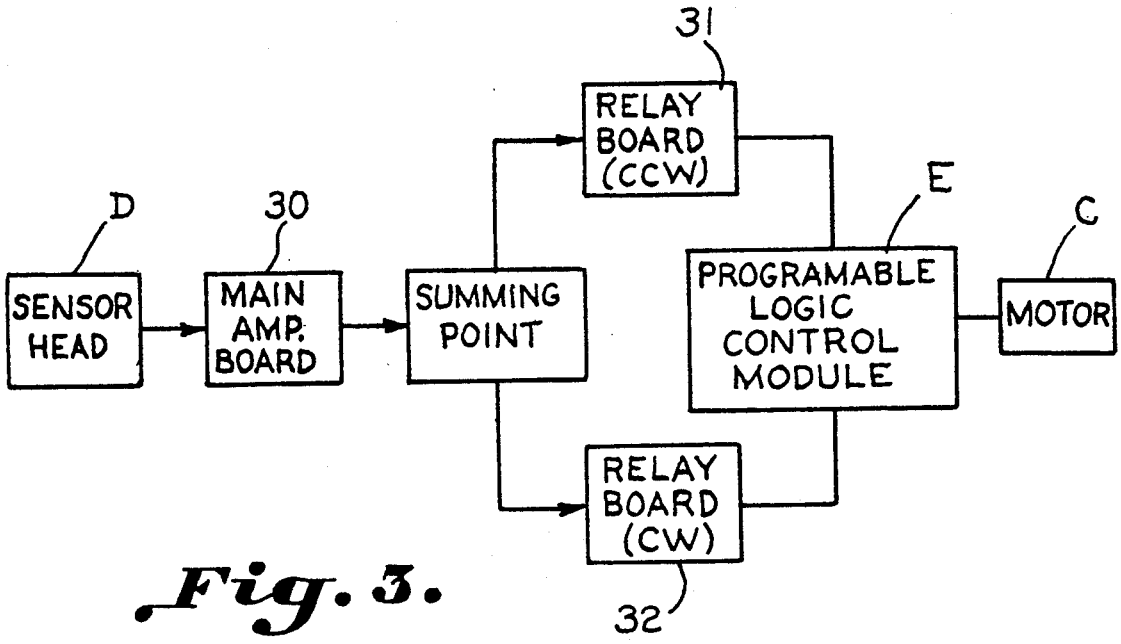
FIG. 3 is the block diagram illustrating control circuitry for operating the belt let off in connection with which the invention is illustrated.

The belt B is driven by the motor C which imparts a driving force to the roll 13 through the belt 18 from the power take-off 19 to a sheave 20 carried by the roll 13. The roll 13 in turn drives the roll 14 through a belt 21. Referring now to FIGS. 1 and 3 it will be noted that with the web W moving in the direction of the arrow in FIG. 1 that the belt is driven in the direction of the arrow turning the web roll in a clockwise direction as illustrated by the arrow for unwinding the web. An ultrasonic transducer D is carried by a bracket 22 which is in turn supported by a pair of spaced horizontal longitudinal members 23 and 24. The members 23 are so spaced as to accommodate the transducer without the possibility of interfering with the sending and receiving of an ultrasonic signal.

The transducer illustrated may be of the type described as Model SMU100-1 by Carotron, Route 2, Box 405B, Highway 522, Heath Springs, S.C. 29058. Any other suitable ultrasonic detecting apparatus may be utilized.

It will be noted that the web W in FIG. 1 moves upwardly toward the rear of the belt let-off from beneath the web roll which is turned in a clockwise position by the belt B.

Figure 2:
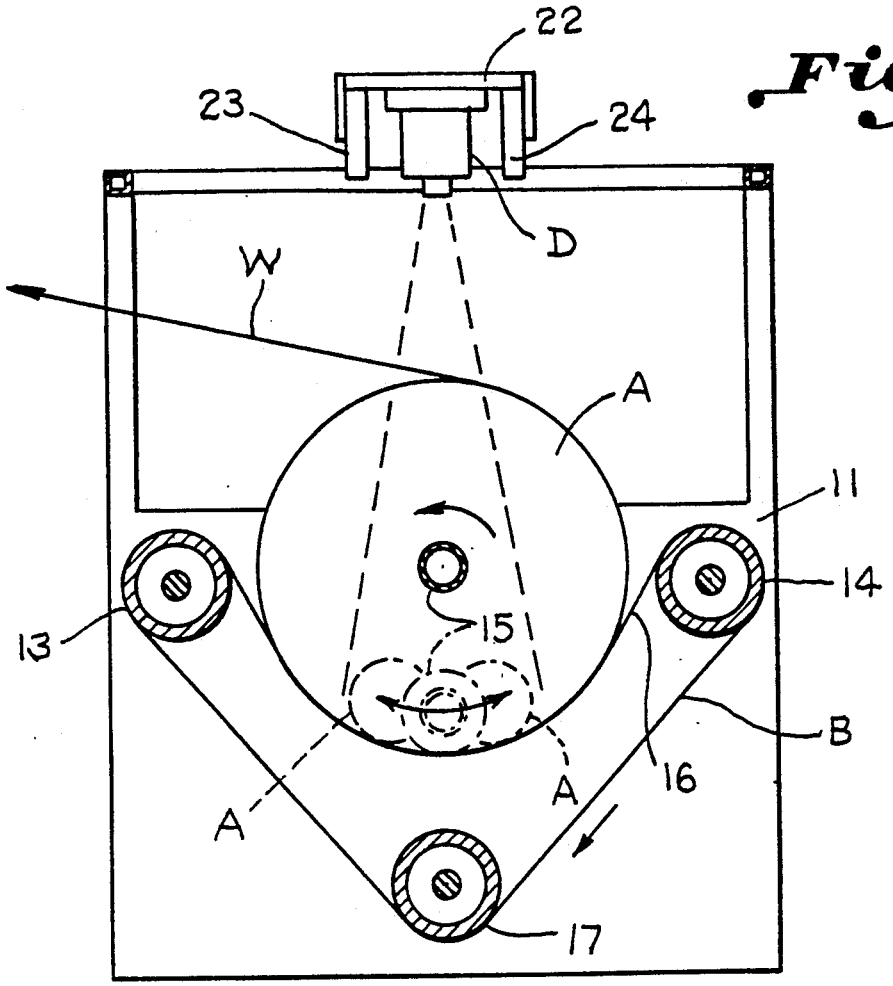
FIG. 2 is an illustration of a modified form of belt let off utilizing the invention.

In FIG. 2 the web roll A is being turned in a counter clockwise direction so that the web N moves rearwardly on top of the web roll. A provision is made for control of the belt B for turning the web roll in a clockwise or counter clockwise direction as illustrated in FIG. 3.

In FIG. 3 the transducer D is illustrated as including a sensor head which receives and sends a signal to the main amplification board 30. The signal from the main amplification board is sent to the electronic relay control boards 31 and 32 which is then sent to the programmable logic control E. Signals come from the selectable relay boards 31 or 32 to the control module E depending upon whether or not rotation of the web roll is to be in a counter clockwise or clockwise direction respectively. Respective relay boards control the operation of the motor C for slowing down, speeding up, reversing or stopping entirely winding responsive to the programmable logic control mechanism.

It is thus seen that a reliable web roll control apparatus and method has been provided wherein a detector is positioned above the roll for sending and receiving of the signal indicating the relative size of the web roll. A switch relay puts the apparatus in a slow speed mode when the roll reaches a predetermined diameter. When the winding operation is complete and the apparatus has been brought to a stop the apparatus is reset by pushing a stop button provided for that purpose.

By utilizing the ultrasonic signal it is possible to accurately detect the core. Even though the core is rocking, the cone shape of the ultrasonic detector still covers the small fabric roll.

An important benefit of the ultrasonic detector over the photo electric system is that it does not get out of alignment. The only signal is the ultrasonic signal which is received back through the ultrasonic sensor.

It will be observed that the ultrasonic apparatus hereof does not get out of alignment as photo electronic apparatus is prone to do. The ultrasonic signal expands but is received back through the ultrasonic sensor for accurate roll size determinations. The cone shape of the ultrasonic detector keeps the small roll under its beam despite rocking back and forth as illustrated in FIG. 2.

While a preferred embodiment of the invention has been described used specific terms, such description is for illustrative purposes only, and it is to be understood that changes and variations may be made without departing from the spirit or scope of the following claims.

What is claimed is:

1. Apparatus for unwinding a web roll comprising:

a control device for positioning a web roll transversely upon a looped drive belt for winding and unwinding a web from said web roll thereby varying the size of said web roll;

an electric motor driving said looped drive belt during winding and unwinding of said web roll;

a trough in said looped drive belt supporting said web roll during winding and unwinding without restraint upon the web roll causing said web roll to rock back and forth in a longitudinal direction in the trough;

an ultrasonic transducer carried above and directed downwardly toward said web roll sending a signal and receiving a return signal indicative of the size of said web roll while said roll is rocking back and forth changing its position upon said belt; and signaling means actuated by said ultrasonic transducer when said web roll reaches a predetermined size producing a change of operation in said electric motor while said web roll is rocking back and forth.

2. The structure set forth in claim 1 wherein said control device includes web delivery means for alternately winding or unwinding said web roll, and control means for selecting rotation of said web roller in a clockwise or counterclockwise direction.

3. The method of winding and unwinding a web roll comprising the steps of:

positioning a web roll transversely upon a looped drive belt for winding and unwinding a web from said roll thereby varying the size of the web roll;

driving said looped drive belt during winding and unwinding the web;

supporting said web roll upon a trough in a substantially horizontal portion of said looped drive belt during winding and unwinding without restraint upon the ends of said web roll causing said web roll to rock back and forth in a longitudinal direction in the trough;

directing an ultrasonic signal downwardly toward said web roll and receiving a return signal controlled by the diameter of said web roll while said roll is rocking back and forth changing its position upon said belt; and generating an output signal to said electric motor in response to said return signal from said web roll while rocking back and forth changing its position upon said belt, producing a change of speed in said electric motor directly proportional to said diameter of said web roll.

* * * * *